US011539153B2

(12) United States Patent
Tsuji et al.

(10) Patent No.: US 11,539,153 B2
(45) Date of Patent: Dec. 27, 2022

(54) CONNECTOR

(71) Applicant: Tyco Electronics Japan G.K., Kawasaki (JP)

(72) Inventors: Junya Tsuji, Kawasaki (JP); Katsuhiko Kobayashi, Kawasaki (JP)

(73) Assignee: Tyco Electronics Japan G.K.

( * ) Notice: Subject to any disclaimer, the term of this patent is extended or adjusted under 35 U.S.C. 154(b) by 0 days.

(21) Appl. No.: 16/512,441

(22) Filed: Jul. 16, 2019

(65) Prior Publication Data

US 2020/0028290 A1 Jan. 23, 2020

(30) Foreign Application Priority Data

Jul. 17, 2018 (JP) ..... JP2018-134135

(51) Int. Cl.
*H01R 24/00* (2011.01)
*H01R 12/73* (2011.01)
*H01R 12/72* (2011.01)

(52) U.S. Cl.
CPC ..... *H01R 12/73* (2013.01); *H01R 12/721* (2013.01)

(58) Field of Classification Search
CPC ..... H01R 23/7068; H01R 13/6658; H01R 13/725; H01R 23/688
USPC ..... 439/631, 76.1, 61, 637, 60
See application file for complete search history.

(56) References Cited

U.S. PATENT DOCUMENTS 3,413,594 A * 11/1968 Fernald ..... H01R 12/727 439/637
7,080,999 B2 6/2006 Narui
7,976,344 B2 * 7/2011 Brunker ..... H01R 13/504 439/631

FOREIGN PATENT DOCUMENTS

| | | | |
|---|---|---|---|
| CN | 106654683 | A | 5/2017 |
| JP | 5-15744 | Y2 | 4/1993 |
| JP | 2003142183 | A | 5/2003 |
| JP | 2003-272746 | A | 9/2003 |
| JP | 2006012708 | A | 1/2006 |
| JP | 2009-129576 | A | 6/2009 |
| JP | 2009300330 | A | 12/2009 |
| JP | 2013-38076 | A | 2/2013 |

OTHER PUBLICATIONS

Abstract of JP 2009129576, dated Jun. 11, 2009, 1 page.
(Continued)

*Primary Examiner* — Phuong Chi Thi Nguyen
(74) *Attorney, Agent, or Firm* — Barley Snyder

(57) ABSTRACT

A connector includes a housing and a contact elongated in a frontward and rearward direction. The contact has a fixed portion fixed to the housing in a middle in the frontward and rearward direction, a first contact portion formed in a front end portion for coming into contact with a first circuit board, a second contact portion formed in a rear end portion for coming into contact with a second circuit board, and a deflective portion formed between the fixed portion and the second contact portion. The deflective portion is adapted to deflect when the second contact portion receives a force from the second circuit board.

19 Claims, 6 Drawing Sheets

(56) References Cited

OTHER PUBLICATIONS

Japanese Office Action and English translation thereof corresponding to Application No. 201910645246.7, dated Jul. 21, 2022, 10 pages.
Japanese Search Report dated Jul. 17, 2022 corresponding to Application No. 201910645246.7, 2 pages.
Notice of Reasons for Refusal and English translation thereof, Application No. 2018-134135, dated Apr. 15, 2022, 8 pages.

* cited by examiner

CONNECTOR

CROSS-REFERENCE TO RELATED APPLICATIONS

This application claims the benefit of the filing date under 35 U.S.C. § 119(a)-(d) of Japanese Patent Application No. 2018-134135, filed on Jul. 17, 2018.

FIELD OF THE INVENTION

The present invention relates to a connector and, more particularly, to a contact of a connector.

BACKGROUND

A connector for connecting a pair of circuit boards has a housing with a first receiving portion receiving an end portion of a first circuit board plugged in from a front. A second receiving portion of the housing receives an end portion of a second circuit board plugged in from behind. A contact of the connector has a first contact portion contacting the first circuit board received in the first receiving portion and a second contact portion contacting the second circuit board plugged into the second receiving portion. The contact is elongated in frontward and rearward directions and has a fixed portion fixed to the housing in a middle portion thereof.

It is necessary to ensure that the second contact portion comes into contact with the second circuit board when the second circuit board is received in the second receiving portion. For this reason, the second contact portion is so located as to interfere with the second circuit board when that second circuit board is received. Moreover, when the second circuit board is received, the second contact portion elastically deforms under a pressing force from the second circuit board. A portion of the housing supporting the fixed portion supports a stress due to this elastic deformation.

The second circuit board received in the second receiving portion and the second contact portion may be soldered together in a reflow oven. The connector having the second circuit board received therein is put into the reflow oven. Thereupon, the housing softens, and the housing may deform due to the stress. If the housing deforms, the pressing force received by the second contact portion affects the first contact portion near the first receiving portion and, consequently, the position of the first contact portion changes; the attitude of the contact changes.

Removing the connector from the reflow oven then results in fixation of the changed attitude of the contact. If this happens, when the first circuit board is received in the first receiving portion, the contact pressure of the first contact portion to the first circuit board may be too strong, resulting in damage to the first circuit board. Alternatively, if there is a considerable change in the attitude of the contact, the contact may collide with the first circuit board plugged into the first receiving portion, resulting in buckling.

Japanese Patent Application No. JP 2009-129576A discloses an electronic device in which a stress relief structure for relieving a stress due to a screw connection is provided between a supporting portion for a housing and a screwing portion; a contact supported by the housing is connected to a circuit board by screwing. However, J P 2009-129576A discloses a structure for relieving a stress due to screwing, not a structure that takes into consideration thermal deformation of the housing. In addition, JP 2009-129576A does not contemplate the contact coming into contact with two circuit boards. Consequently, there is a need for a connector capable of inhibiting a change in the attitude of the contact even when heating softens the housing.

SUMMARY

A connector includes a housing and a contact elongated in a frontward and rearward direction. The contact has a fixed portion fixed to the housing in a middle in the frontward and rearward direction, a first contact portion formed in a front end portion for coming into contact with a first circuit board, a second contact portion formed in a rear end portion for coming into contact with a second circuit board, and a deflective portion formed between the fixed portion and the second contact portion. The deflective portion is adapted to deflect when the second contact portion receives a force from the second circuit board.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
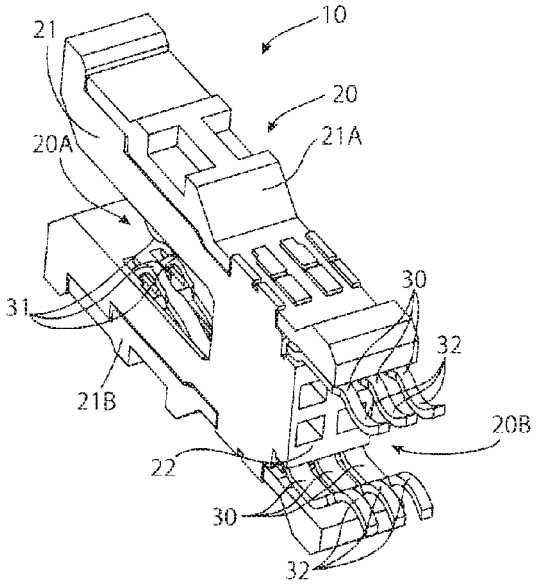
FIG. 1 is a perspective view of a connector according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

Figure 2:
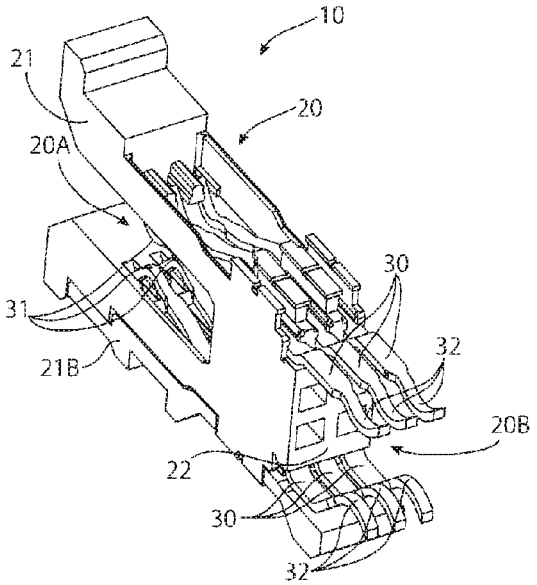
FIG. 2 is a perspective view of a housing main body and a plurality of contacts of the connector.

A connector 10 according to an embodiment, as shown in FIGS. 1 and 2, comprises a housing 20 and a plurality of contacts 30. The housing 20 is composed of a housing main body 21 with an upper outer housing 21A and a lower outer housing 21B. In the shown embodiment, the contacts 30 are arranged in two rows, upper and lower rows, and here three contacts 30 are arranged for each of the upper and lower rows. In other embodiments, a large number of contacts 30, for example, eighty-four contacts 30 are arranged for each of the upper and lower rows.

As shown in FIGS. 1-4, a first receiving portion 20A and a second receiving portion 20B are formed in the housing 20 of the connector 10. The first receiving portion 20A receives a circuit board 50 plugged in from a front side; a right side in FIG. 4. The second receiving portion 20B receives a circuit board 60 plugged in from a rear side; a left side in FIG. 4.

Each contact 30, as shown in FIGS. 1-4, has a shape elongated in a frontward and rearward direction and has a fixed portion 33 fixed to the housing 20 in the middle in the frontward and rearward direction. The contact 30 has a first contact portion 31 formed in a front end portion and a second contact portion 32 formed in a rear end portion. The first contact portion 31 is a contact portion for coming into contact with a connection pad formed on the first circuit board 50 to be electrically connected to the first circuit board 50. The second contact portion 32 is a contact portion for coming into contact with a connection pad formed on the second circuit board 60 to be electrically connected to the second circuit board 60. The connector 10 has a structure in which the contacts 30 are arranged in upper and lower two rows and each end portion of the first circuit board 50 and the second circuit board 60 is pinched by the contacts 30 from above and below.

Figure 3:
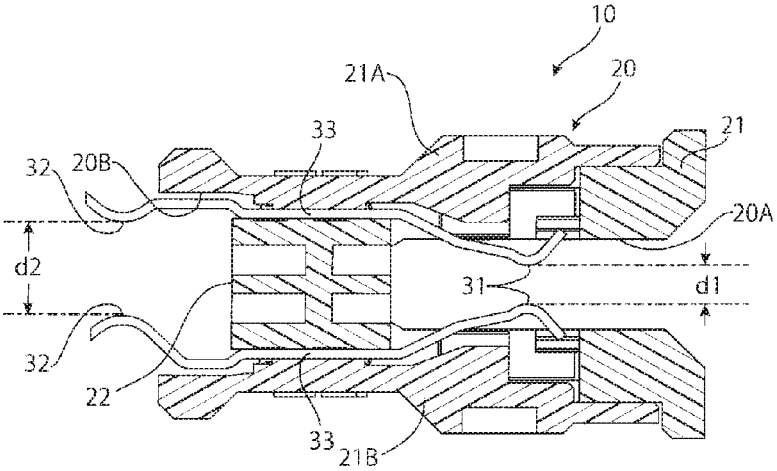
FIG. 3 is a sectional side view of the connector.
Figure 4:
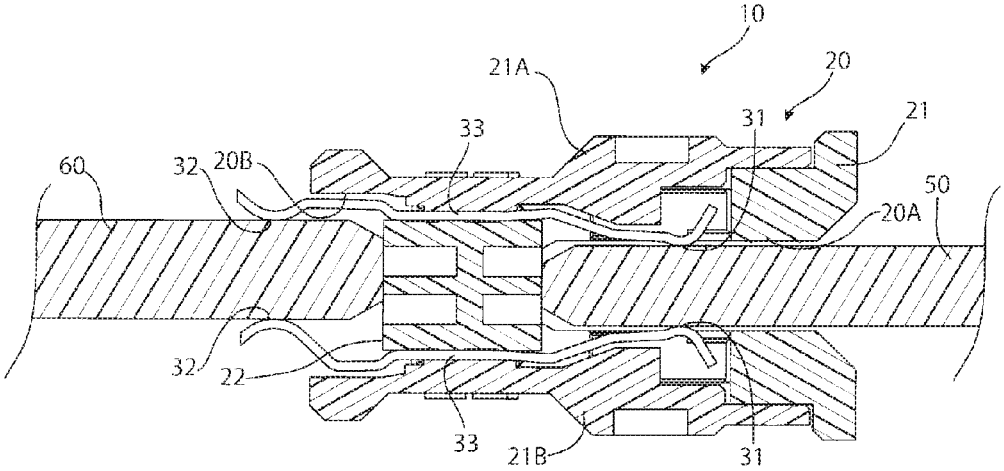
FIG. 4 is a sectional side view of the connector with a first circuit board and a second circuit board received in the connector.

The connector 10 is heated in a reflow oven with the second circuit board 60 received in the second receiving portion 20B, with the second circuit board 60 abutting on an abutting portion 22 of the housing 20 shown in FIGS. 3 and 4, and without the first circuit board 50 received. By putting the connector 10 into the reflow oven, the second contact portion 32 and the second circuit board 60 are soldered together, and thus the connector 10 becomes a straddle mount connector. The connector 10 is also a card edge connector in which the first circuit board 50 is received in the first receiving portion 20A as to be freely plugged thereinto/extracted therefrom.

It is necessary to ensure that the second contact portion 32 comes into contact with the received second circuit board 60 in order to prevent a soldering failure from occurring. Therefore, a distance d2 between the second contact portions 32 of the vertically-arranged two contacts 30 shown in FIG. 3 is a distance narrower than the thickness of the second circuit board 60. The same applies to the first contact portion 31; a distance d1 between the first contact portions 31 of the vertically-arranged two contacts 30 is so set as to be a distance that brings them into contact with the first circuit board 50 plugged thereinto with a proper contact pressure.

Because the distance d2 between the second contact portions 32 is set narrower than the thickness of the second circuit board 60, when the second circuit board 60 is plugged in, the second circuit board 60 widens the distance d2. A portion of the contact 30 nearer to the second contact portion 32 than the fixed portion 33 elastically deforms, thereby applying a stress to the housing 20. The distance d2 between the second contact portions 32 and/or the thickness of the second circuit board 60 may also have a tolerance, and, depending on a combination of these tolerances, the second contact portions 32 may also be pushed apart strongly.

When the second circuit board 60 is soldered to the connector 10, the housing 20 is also heated in the reflow oven, and thus the housing 20 softens. If a connector in which the second contact portions 32 are pushed apart strongly by the second circuit board 60 is put into the reflow oven, the housing 20 softened by heating may deform due to the strong force. If the housing 20 still deformed is removed from the reflow oven and returns to room temperature, the housing 20 hardens again, staying deformed. This deformation of the housing 20 leads to a change in the attitude of the contact 30, which is an attitude having the distance d1 between the first contact portions 31 narrowed. If the first circuit board 50 is plugged into the connector 10 having such a change in the attitude of the contact 30, the first contact portion 31 may come into contact with the first circuit board 50 unnecessarily strongly, resulting in a damage to the first circuit board 50. Alternatively, the contact 30 may also collide with a front end face of the first circuit board 50, resulting in buckling.

The connector 10 of the present embodiment inhibits a change in the attitude of the contact 30 due to being put into the reflow oven in the following manner.

Figure 5A:
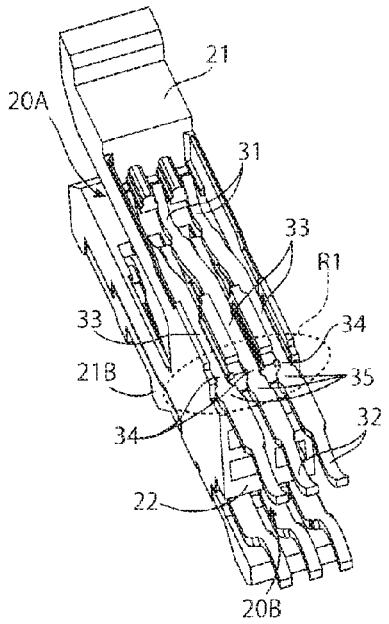
FIG. 5A is a perspective view of the housing main body with the contacts.
Figure 5B:
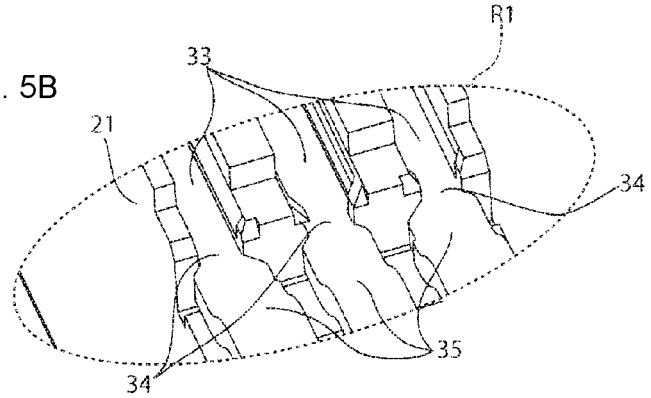
FIG. 5B is an enlarged view of a portion R1 of FIG. 5A.
Figure 6A:
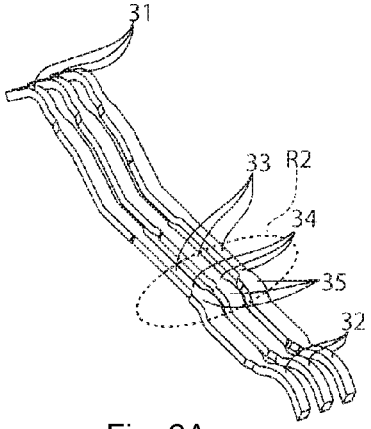
FIG. 6A is a perspective view of the contacts of the connector.
Figure 6B:
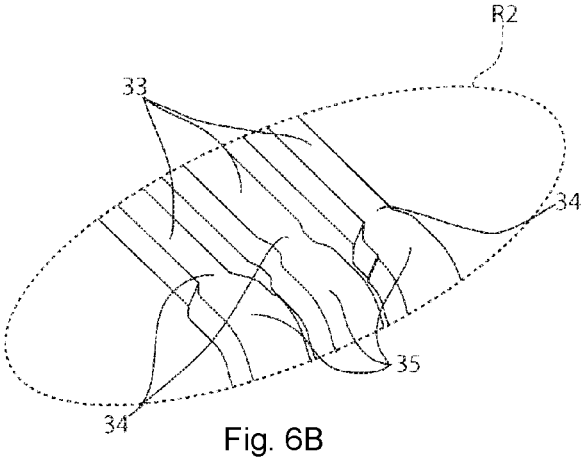
FIG. 6B is an enlarged view of a portion R2 of FIG. 6A.

As shown in FIGS. 5A-6B, a deflective portion 34 is formed in each of the three arranged contacts 30. The deflective portion 34 is formed in a position which is nearer to the second contact portion 32 than the fixed portion 33 pinched and fixed by walls of the housing main body 21. The deflective portion 34, as shown in FIGS. 5A and 5B, is not supported by the housing 20 from above and below. The deflective portion 34 has a structure or shape that deflects most easily among portions exposed nearer to the second contact portion 32 than the fixed portion 33. When the second contact portion 32 is pushed by the second circuit board 60, the deflective portion 34 deflects to relieve a force transmitted to the housing 20. Thereby, even when heating in the reflow oven softens the housing 20, the deformation of the housing 20 and the change in the attitude of the contact 30 are inhibited.

The deflective portions 34 of the lateral two contacts 30 of the three contacts 30 shown in FIGS. 5A-6B are so formed as to be narrower than an adjoining portion 35 adjoining the deflective portion 34 near the second contact portion 32. The deflective portion 34 of one central contact 30 of these three contacts 30 is so formed as to have a shape so depressed as to be narrower than both portions, the adjoining portion 35 and the fixed portion 33, adjacent the deflective portion 34. In another embodiment, the deflective portion 34 is thinner than both the adjoining portion 35 and the fixed portion 33. The deflective portion 34 having any of these shapes easily deflects. Although three contacts 30 are illustrated and the lateral contacts 30 and the central contact 30 have different shapes in the present embodiment, all the contacts 30 may have the same shape, or a combination of four or another number of contacts 30 may be used in other embodiments.

The deflective portion 34 is only required to be formed in a position which is nearer to the second contact portion 32 (a soldered side) than the fixed portion 33 fixed to the housing 20, and which is not fixed to the housing 20 from above and below, and to have an easily-deflecting structure or shape. That is, the deflective portion 34 is not limited to the illustrated narrower or depressed shape. Though the width of the contact 30 is narrowed in FIGS. 5A-6B, the deflective portion 34 may have, for example, a shape obtained by reducing the thickness of the contact 30, or the contact 30 may be provided with a slit or a hole so that the deflective portion 34 can easily deflect.

What is claimed is:

1. A connector, comprising:

a housing having a receiving portion receiving an end portion of a first circuit board plugged in from a front side of the housing and an abutting portion abutting an end portion of a second circuit board plugged in from a rear side of the housing; and a contact elongated in a frontward and rearward direction, the contact having a fixed portion fixed to the housing in a middle in the frontward and rearward direction, a first contact portion formed in a front end portion for coming into contact with the first circuit board to be electrically connected to the first circuit board, a second contact portion formed in a rear end portion for coming into contact with the second circuit board to be soldered to the second circuit board, a deflective portion formed between the fixed portion and the second contact portion, and an adjoining portion adjoining the deflective portion and located near the second contact portion, the deflective portion is adapted to deflect in a thickness direction orthogonal to the frontward and rearward direction when the second contact portion receives a force from the second circuit board, the deflective portion has a width smaller than a width of the adjoining portion in a width direction orthogonal to both the thickness direction and the frontward and rearward direction, the deflective portion relieving a stress transmitted to the housing by deflecting more than the adjoining portion when the second contact portion receives the force from the second circuit board.

2. The connector of claim 1, wherein the deflective portion is narrower than both the adjoining portion and the fixed portion adjacent the deflective portion.

3. The connector of claim 1, wherein the deflective portion is thinner than both the adjoining portion and the fixed portion adjacent the deflective portion.

4. The connector of claim 1, further comprising a plurality of contacts disposed in a pair of rows and positioned to pinch the first circuit board and the second circuit board.

5. The connector of claim 1, wherein the deflective portion is narrower and/or thinner than the adjoining portion.

6. The connector of claim 1, wherein a free end of the rear end portion is positioned further from the deflective portion than the second contact portion, the free end is spaced apart from the housing when the second circuit board is fully inserted.

7. A connector, comprising:

a housing; and a contact elongated in a frontward and rearward direction, the contact having a fixed portion fixed to the housing in a middle in the frontward and rearward direction, a first contact portion formed in a front end portion for coming into contact with a first circuit board, a second contact portion formed in a rear end portion for coming into contact with a second circuit board, a deflective portion formed between the fixed portion and the second contact portion, and an adjoining portion adjoining the deflective portion and located near the second contact portion, the deflective portion is adapted to deflect in a thickness direction orthogonal to the frontward and rearward direction when the second contact portion receives a force from the second circuit board, the deflective portion has a width smaller than a width of the adjoining portion in a width direction orthogonal to both the thickness direction and the frontward and rearward direction, the deflective portion adapted to deflect more than the adjoining portion when the second contact portion receives the force from the second circuit board.

8. The connector of claim 7, further comprising a plurality of contacts disposed in a pair of rows and positioned to pinch the first circuit board and the second circuit board.

9. The connector of claim 7, wherein the deflective portion is thinner than the adjoining portion.

10. The connector of claim 7, wherein a free end of the rear end portion is positioned further from the deflective portion than the second contact portion, the free end is spaced apart from the housing when the second circuit board is fully inserted.

11. The connector of claim 7, wherein the deflective portion is narrower than the adjoining portion.

12. The connector of claim 11, wherein the deflective portion is narrower than both the adjoining portion and the fixed portion adjacent the deflective portion.

13. The connector of claim 7, wherein the housing has a first receiving portion receiving the first circuit board plugged in from a front side of the housing.

14. The connector of claim 13, wherein the housing has an abutting portion abutting an end portion of the second circuit board.

15. The connector of claim 14, wherein the housing has a second receiving portion receiving the second circuit board plugged in from a rear side of the housing.

16. A contact, comprising:

a fixed portion;

a first contact portion formed in a front end portion for coming into contact with a first circuit board;

a second contact portion formed in a rear end portion opposite the front end portion in a frontward and rearward direction for coming into contact with a second circuit board;

a deflective portion formed between the fixed portion and the second contact portion adapted to deflect in a thickness direction orthogonal to the frontward and rearward direction when the second contact portion receives a force from the second circuit board; and an adjoining portion adjoining the deflective portion and located near the second contact portion, the deflective portion has a width smaller than a width of the adjoining portion in a width direction orthogonal to both the thickness direction and the frontward and rearward direction.

17. The contact of claim 16, wherein the fixed portion is fixed to a housing.

18. The contact of claim 16, wherein the width of the deflective portion is smaller than a width of the fixed portion in the width direction.

19. The contact of claim 16, wherein the deflective portion is narrower than the adjoining portion in the thickness direction.

* * * * *